US005570498A

United States Patent [19]

Hipkiss et al.

[11] Patent Number: 5,570,498

[45] Date of Patent: Nov. 5, 1996

[54] LIFT-OFF DOOR HINGE

[75] Inventors: Arthur S. Hipkiss, Shelby Township; Charles R. Fain, Sterling Heights; Cheryl L. Barr, Rochester Hills, all of Mich.

[73] Assignee: General Motors Corporation, Detroit, Mich.

[21] Appl. No.: 433,882

[22] Filed: May 2, 1995

[51] Int. Cl.[6] ..... E05D 7/10; E05D 7/12; E05D 11/10

[52] U.S. Cl. ..... 16/258; 16/261; 16/264; 16/265; 16/333; 16/334; 16/344; 16/347

[58] Field of Search ..... 16/260, 261, 263, 16/264, 265, 270, 258, 255, 333, 334, 347, 344

[56] References Cited

U.S. PATENT DOCUMENTS

| | | | |
|---|---|---|---|
| 3,205,007 | 9/1965 | Sommer | 297/429 |
| 4,446,596 | 5/1984 | Arlauskas | 16/333 |
| 4,532,675 | 8/1985 | Salazar | 16/335 |
| 4,720,895 | 1/1988 | Peebles | 16/264 |
| 4,748,718 | 6/1988 | Harrison | 16/254 |
| 4,765,025 | 8/1988 | Salazar | 16/261 |
| 4,766,643 | 3/1988 | Salazar | 16/222 |
| 4,800,624 | 1/1989 | Whitefoot et al. | 16/332 |
| 4,858,274 | 8/1989 | Harrison et al. | 16/265 |
| 4,864,687 | 9/1989 | Calcaterra et al. | 16/237 |
| 4,881,298 | 11/1989 | Turnbull | 16/266 |
| 5,018,243 | 5/1991 | Anspaugh et al. | 16/335 |
| 5,054,165 | 10/1991 | Marchione | 16/270 |
| 5,067,201 | 11/1991 | Marchione | 16/270 |
| 5,297,314 | 3/1994 | Bender et al. | 16/270 |

FOREIGN PATENT DOCUMENTS

| | | | |
|---|---|---|---|
| 2657112 | 7/1991 | France | 16/265 |

*Primary Examiner*—M. Rachuba
*Assistant Examiner*—Donald M. Gurley
*Attorney, Agent, or Firm*—Ernest E. Helms

[57] ABSTRACT

A lift-off type door hinge for pivotally and detachably connecting a door to a vehicle body is provided including a body strap with a base for connection to the vehicle body with generally horizontally projecting upper and lower arms projecting therefrom, the upper and lower arms having generally aligned apertures with first and second pins extending therethrough, the body strap also having a reaction surface, a mid-strap, the mid-strap having a main body with generally horizontally projecting upper and lower arms, the mid-strap arms via the first and second pins being pivotally attached with respect to the body strap, the mid-strap lower arm also having a door aperture, and the mid-strap also having a reaction surface, a spring extending between the reaction surfaces of the body strap and the mid-strap to bias the mid-strap to a hold open position with respect to the body strap when the door is open, and a door strap, the door strap having a main body fixably connected to the door and the door having first, second and third arms extending generally horizontally outwardly, the first and second arms having apertures to allow for pivotal connection with the first and second pins, respectively, the first and second arms being able to be removed from the first and second pins by upward movement to remove the door, the door strap third arm being pivotally attached to the mid-strap lower arm by a removable fastener.

3 Claims, 2 Drawing Sheets

LIFT-OFF DOOR HINGE

FIELD OF THE INVENTION

The field of the present invention is that of door hinges for automotive-type vehicles. More particularly, the field of the present invention is that of door hinges for automotive-type vehicles wherein the door may be readily removed during the assembly process.

BACKGROUND OF THE INVENTION

In most automotive assembly plants, a vehicle body is first fabricated and the doors are then attached. The automotive vehicle goes through the painting process with the doors attached to ensure proper color matching between the paint on the doors and the remainder of the vehicle body. As the vehicle body proceeds along the assembly process, the doors are left open as the assemblers install the instrument panel, the seating and other interior components. To increase the quality of installation and to address other ergonomic issues, there is a growing tendency to remove the vehicle doors from the vehicle body after the painting process to allow greater ease of access to the interior of the vehicle and then reattach the doors to the vehicle further down the assembly process. This technique of automotive assembly is called "doors off" processing.

To accomplish the above-noted technique of automotive assembly, various removable door hinges have previously been brought forth. The majority, if not all, of the prior removable-type door hinges do not include a hold open device or require that the hold open device be disassembled. Therefore, a separate hold open device is utilized. (Hold open devices are the mechanism which biases the vehicle door to stay in the open position when the vehicle door is open.)

SUMMARY OF THE INVENTION

The present invention provides a separable door hinge which is an alternative to that previously available which allows the hold open device to be incorporated into the door hinge and to remain with the vehicle body when the door is removed.

DESCRIPTION OF THE PREFERRED EMBODIMENTS

Figure 1:
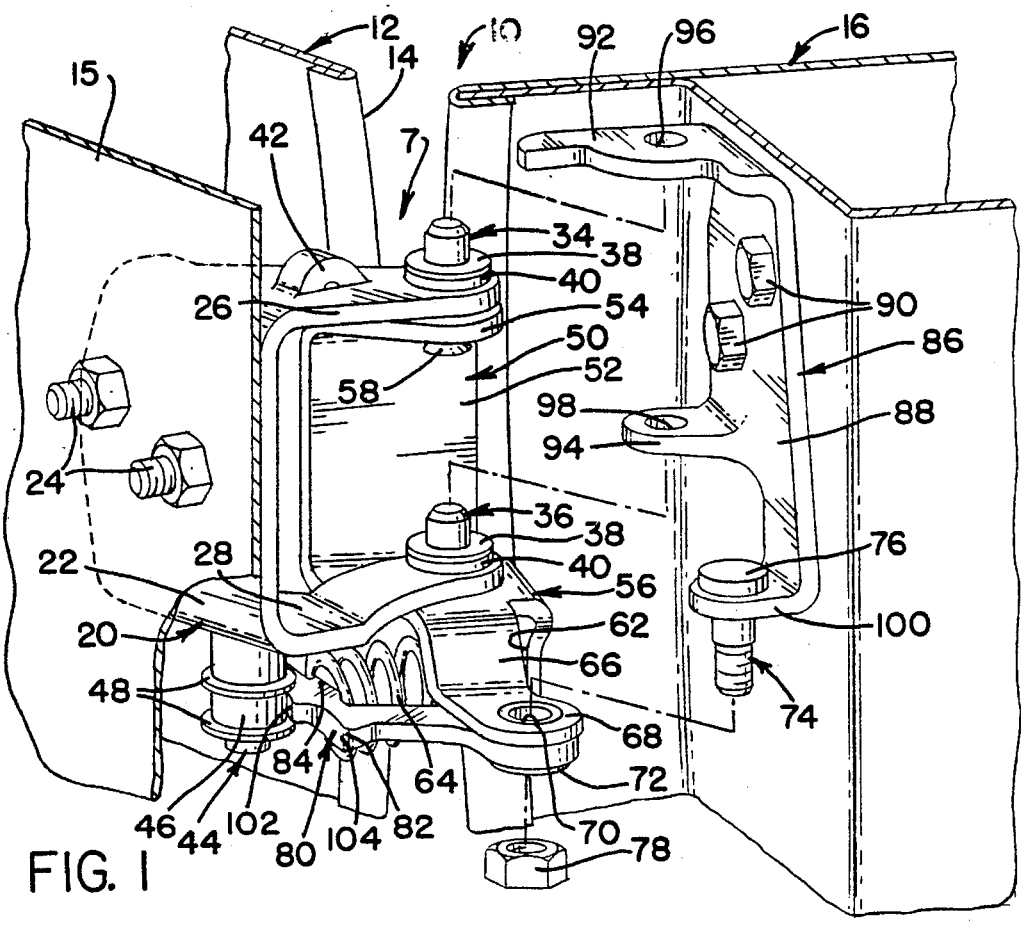
FIG. 1 is a perspective view illustrating a door after removal from an automotive vehicle body showing the environment of the present inventive automotive vehicle separable door hinge with the door being removed from the vehicle body with a door side strap being attached to the door and a body side and mid-strap and hold open mechanism being connected to the vehicle body.

Referring to FIGS. 1 through 4, an automotive vehicle 10 has a vehicle body 12 with a door opening 14. To cover the door opening 14 there is provided a vehicle door 16.

Pivotally connecting the door 16 to the vehicle body 12 is separable hinge 7. The vehicle body 12 has a frame member or section 15 formed of sheet metal which is generally parallel to the orientation of the door opening 14. Joined to the section 15 by two bolts 24 is a body side strap 20.

The body side strap 20 has a base 22 for connection with the section 15. The body side strap 20 also has projecting generally horizontally an upper arm 26 and a lower arm 28. The upper and lower arms 26, 28 have generally aligned apertures 30 and 32, respectively. Aperture 30 has pivotally inserted therein a first cold leaded steel pin 34, and aperture 32 has pivotally inserted therein a second cold headed steel pin 36. First and second pins 34 and 36 are freely pivotal within their respective apertures, and each one has a fixably connected collar 38 which acts as a thrust washer acting upon a plastic or robber washer 40. Additionally, the body side strap 20 upper arm 26 has a stamped push-out 42 which acts as a limiting stop in a manner to be described later.

The body side strap lower arm 28 also fixably connects a reaction post 44 which has rotatably connected thereto a cam bushing 46 with flanges 48.

The weight of the door 16 will be supported by the body side strap 20 either singularly or in combination with another separable hinge (not shown). Pivotally attached with respect to the body side strap 20 is a mid-strap 50. The mid-strap 50 has a main body 52 with a generally horizontally extending upper arm 54 and a generally horizontally extending lower arm 56. An end 58 of the first pin 34 is staked to ensure the fixable connection between the first pin 34 and the mid-strap upper arm 54. In a similar manner, although not identical, the head 60 of the second pin ensures that the lower arm 56 of the mid-strap remains with the second pin 36. It is obvious to those skilled in the art that the aforementioned this arrangement permanently affixes and pivotally attaches the mid-strap 50 to the body side strap 20.

The mid-strap 50 also has a reaction surface 62 (best shown in FIG. 1) which entraps or mounts an end of a coil spring 64.

The mid-strap lower arm 56 also has an inclined portion 66 connecting to a lower flat 68 which further has a door aperture 70.

The door aperture 70 has knurled therein a bearing 72 which mounts a removable fastener 74 which has a head 76 and an associated nut 78. The bearing 72 also pivotally mounts a cam lever 80 having a cam profile surface 82 which interacts with the cam bushing 46 and is captured between the flanges 48 of the cam bushing 46. An end 84 best shown in FIG. 1 mounts an opposite end of the spring 64.

The last major component of the present inventive hinge 7 is the door side strap 86. The door side strap has a main body portion 88 fixably connected via bolts 90 to the door 16. The door side strap 86 has a first generally horizontally extending upper arm 92 and a second generally horizontally extending lower arm 94 having holes 96 and 98, respectively, allowing the arms 92 and 94 to drop down over first and second pins 34 and 36 to pivotally attach the door 16 to the vehicle body 12. The door side strap 86 also has a third generally horizontally extending arm 100 with an aperture which allows insertion of removable fastener 74.

Figure 3:
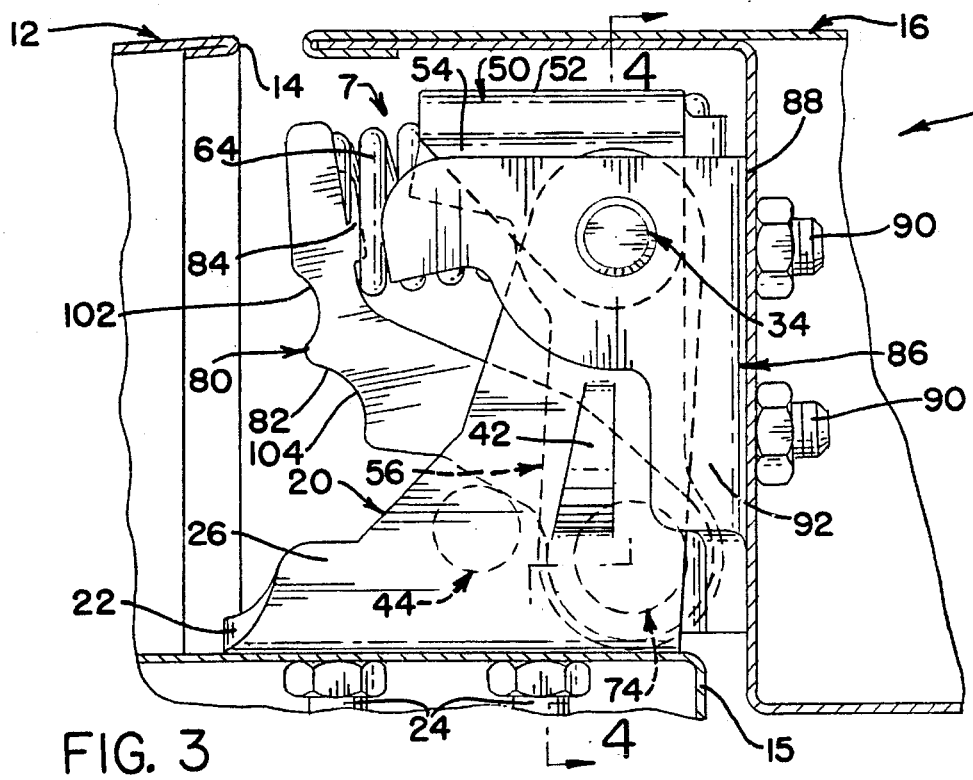
FIG. 3 is a view similar to that of FIG. 2 showing the various positions of the various hinge components when the vehicle door is closed.
Figure 4:
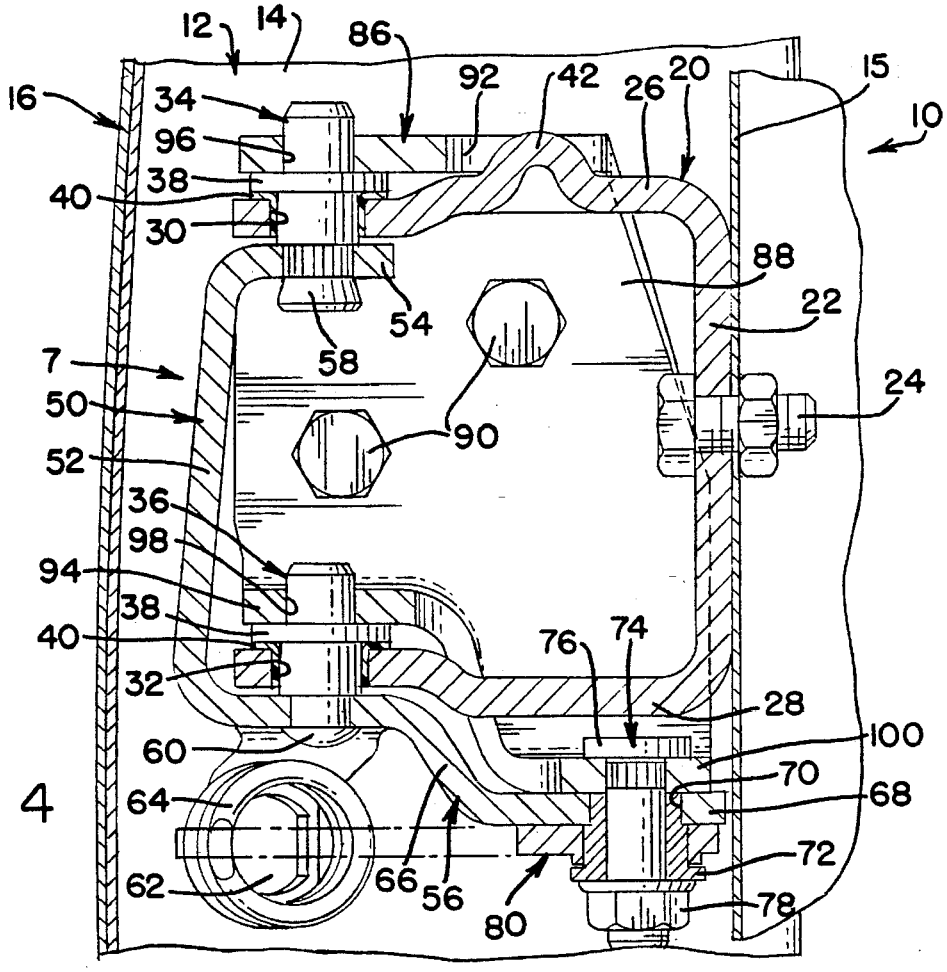
FIG. 4 is a view taken along line 4—4 of FIG. 3.

In operation when fully assembled as shown in FIGS. 3 and 4, removal of the door 16 from the car body 12 can be effectuated by placement of the door 16 in a position to place cam roller 46 into a depression 102 of the cam lever. The spring 64 will react through a reaction surface 62 to cam bushing 46. The nut 78 is then removed from removable fastener 74. The fastener 74 is removed. The door 16 is lifted up, causing the door side upper arm 92 and second arm 94 to lift up from the first pin 34 and the second pin 36, respectively. To reassemble the vehicle door to the body, the removal process is simply reversed.

Figure 2:
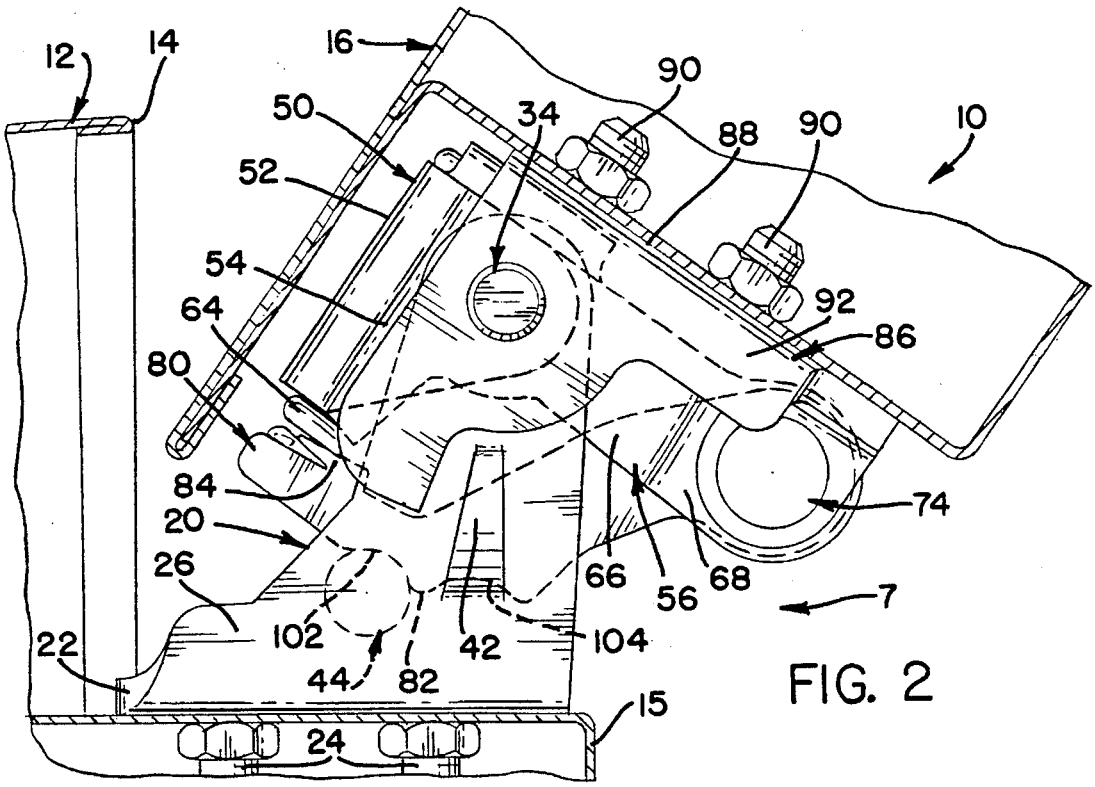
FIG. 2 is an operational view illustrating the hinge according to the present invention when the vehicle door is in its biased open position.

As best shown in FIG. 2, push out 42 acts as a stop against the upper arm 92 of door side strap 86 to limit the maximum opening angle of the door 16. The surface 82 on the cam lever 80 has depressions 102 and 104 to set multiple biased opened positions of the door 16.

While this invention has been described in terms of a preferred embodiment thereof, it will be appreciated that other forms could readily be adapted by one skilled in the art. Accordingly, the scope of this invention is to be considered limited only by the following claims.

What is claimed is:

1. A lift-off type door hinge for pivotally and detachably connecting a vehicle door to an opening frame of an automotive vehicle body comprising:

a body side strap with a base for connection to the opening frame with generally horizontally projecting upper and lower arms projecting therefrom, the upper and lower arms having generally aligned apertures with first and second pins extending therethrough, the body side strap also having a reaction surface;

a mid-strap, the mid-strap having a main body with generally horizontally projecting upper and lower arms, the mid-strap upper and lower arms via the first and second pins being pivotally attached with respect to the body side strap upper and lower arms, the mid-strap lower arm also having a door aperture, and the mid-strap also having a reaction surface;

a spring extending between the reaction surfaces of the body side strap and the mid-strap to bias the mid-strap to a hold open position with respect to the body side strap when the vehicle door is open; and a door side strap, the door side strap having a main body fixably connected to the door and first, second and third arms extending generally horizontally outwardly, the first and second arms having apertures to allow for pivotal connection with the first and second pins, respectively, the first and second arms being able to be removed from the first and second pins by upward movement to remove the door from the vehicle body, the door side strap third arm being pivotally attached to the mid-strap lower arm by a removable fastener extending through the door aperture.

2. A vehicle hinge as described in claim 1 wherein the body side strap reaction surface includes a cam post which is contacted by a cam detent lever pivotally connected to the lower arm of the mid-strap by the removable fastener which connects the door side strap to the mid-strap and wherein the cam lever mounts an end of the spring.

3. A vehicle door hinge as described in claim 1 further including a stop on the upper arm of the body side strap which contacts the upper arm of the door side strap to limit the angular orientation of the door with respect to the vehicle body.

* * * * *